US011254544B2

(12) United States Patent
Hubbard et al.

(10) Patent No.: US 11,254,544 B2
(45) Date of Patent: Feb. 22, 2022

(54) FRICTION LINER AND TRACTION SHEAVE

(71) Applicant: Otis Elevator Company, Farmington, CT (US)

(72) Inventors: James L. Hubbard, Kensington, CT (US); David R. Torlai, Torrington, CT (US); Peter Keyo, Canton, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 6 days.

(21) Appl. No.: 16/993,502

(22) Filed: Aug. 14, 2020

(65) Prior Publication Data

US 2020/0369491 A1 Nov. 26, 2020

Related U.S. Application Data

(62) Division of application No. 16/104,568, filed on Aug. 17, 2018, now Pat. No. 10,766,746.

(51) Int. Cl.
*B66B 15/04* (2006.01)

(52) U.S. Cl.
CPC ..... *B66B 15/04* (2013.01)

(58) Field of Classification Search
CPC ..... B66B 15/05; D07B 1/16
See application file for complete search history.

(56) References Cited

U.S. PATENT DOCUMENTS 1,352,632 A 9/1920 Ross
1,653,062 A 12/1927 Rieske
1,780,627 A * 11/1930 Muller ..... B61B 12/02 295/31.1
1,944,426 A * 1/1934 Greening ..... F16H 55/50 474/178
2,137,987 A * 11/1938 Smith ..... F16H 7/18 474/177
2,806,380 A 9/1957 Martin
3,279,762 A 10/1966 Henry
3,332,665 A 7/1967 Bruns
3,692,280 A 9/1972 Eastcott et al.
3,934,482 A 1/1976 Byers
4,030,569 A 6/1977 Berkovitz
4,287,651 A 9/1981 Cilderman et al.
(Continued)

FOREIGN PATENT DOCUMENTS

DE 636412 C 10/1936
DE 860852 C 12/1952
(Continued)

OTHER PUBLICATIONS

European Patent Office, Extended European Search Report, Application No. 19192179.0-1017, dated Jan. 3, 2020 (8 pp.).
(Continued)

*Primary Examiner* — Michael A Riegelman
(74) *Attorney, Agent, or Firm* — Cantor Colburn LLP

(57) ABSTRACT

Disclosed is a liner for a traction sheave including a top surface and a bottom surface mutually spaced on a height-wise axis (H), a front surface and a back surface mutually spaced on lengthwise axis (L), and a plurality of side surfaces including a first side surface and a second side surface mutually spaced in a widthwise axis (W), wherein in a first cross sectional profile of the plurality of side surfaces forms convergent-divergent profile.

14 Claims, 3 Drawing Sheets

(56) References Cited

U.S. PATENT DOCUMENTS

| | | | | |
|---|---|---|---|---|
| 4,441,692 | A * | 4/1984 | Kovaleski | B66D 3/08 254/390 |
| 4,591,025 | A * | 5/1986 | Honda | B66B 15/04 187/266 |
| 5,792,294 | A | 8/1998 | Randazzo et al. | |
| 5,881,843 | A | 3/1999 | O'Donnell et al. | |
| 6,371,448 | B1 | 4/2002 | De Angelis | |
| 6,635,000 | B2 * | 10/2003 | Meindl | B61B 12/02 492/39 |
| 6,796,919 | B2 | 9/2004 | Johnson | |
| 7,431,269 | B2 | 10/2008 | Carlson et al. | |
| 7,461,721 | B2 | 12/2008 | Aulanko et al. | |
| 8,020,669 | B2 | 9/2011 | Aulanko et al. | |
| 8,132,789 | B2 | 3/2012 | Graebner | |
| 8,556,041 | B2 | 10/2013 | Mustalahti et al. | |
| 8,863,906 | B2 | 10/2014 | Mustalahti et al. | |
| 9,212,029 | B2 * | 12/2015 | Aulanko | B66B 15/04 |
| 9,315,938 | B2 | 4/2016 | Aulanko et al. | |
| 9,352,935 | B2 | 5/2016 | Baranda et al. | |
| 9,573,792 | B2 | 2/2017 | Aulanko et al. | |
| 9,695,014 | B2 | 7/2017 | Begle | |
| 10,766,746 | B2 * | 9/2020 | Hubbard | B66B 15/04 |
| 11,117,787 | B2 * | 9/2021 | Martin | B66B 15/04 |
| 2001/0039985 | A1 * | 11/2001 | Johnson | F16H 55/36 152/70 |
| 2002/0000346 | A1 | 1/2002 | Baranda et al. | |
| 2003/0183458 | A1 | 10/2003 | Mustalahti et al. | |
| 2003/0192743 | A1 | 10/2003 | Aulanko et al. | |
| 2005/0006180 | A1 | 1/2005 | Mustalahti | |
| 2011/0108785 | A1 | 5/2011 | Graebner | |
| 2011/0259676 | A1 | 10/2011 | Nardi et al. | |
| 2012/0318615 | A1 * | 12/2012 | Aulanko | F16H 55/38 187/254 |
| 2016/0126810 | A1 | 5/2016 | Hubbard et al. | |
| 2016/0318737 | A1 | 11/2016 | Joki | |
| 2017/0267497 | A1 | 9/2017 | Ma et al. | |
| 2018/0244499 | A1 | 8/2018 | Zapf | |
| 2019/0047826 | A1 | 2/2019 | Lee et al. | |
| 2020/0055707 | A1 | 2/2020 | Hubbard et al. | |

FOREIGN PATENT DOCUMENTS

| | | | |
|---|---|---|---|
| DE | 1016509 | B | 9/1957 |
| DE | 1025684 | B | 3/1958 |
| DE | 1081285 | B | 5/1960 |
| DE | 3024177 | A1 | 1/1982 |
| EP | 2684831 | A1 | 1/2014 |
| EP | 3502031 | A1 | 6/2019 |
| FR | 1186151 | A | 8/1959 |
| FR | 1216553 | A | 4/1960 |
| FR | 1218823 | A | 5/1960 |
| FR | 1263681 | A | 6/1961 |
| GB | 826960 | A | 1/1960 |
| GB | 1121220 | A | 7/1968 |
| JP | 512862 | A | 1/1976 |

OTHER PUBLICATIONS

Chinese Office Action Issued in Chinese Application No. 201910757379.3 dated Mar. 23, 2021; 4 Pages.

* cited by examiner

FRICTION LINER AND TRACTION SHEAVE

CROSS-REFERENCE TO RELATED APPLICATIONS

This application is a Division of U.S. Non-Provisional application Ser. No. 16/104,568 filed Aug. 17, 2018, the disclosure of which is incorporated herein by reference in its entirety.

BACKGROUND

The embodiments herein relate to elevator sheaves and more specifically to a friction liner and a traction sheave.

Traction liners may be stretched over a sheave with the ends of a traction liner connected using a chain, or otherwise fastened to the sheave. These liners and method of attaching the liners may not work with liner materials having low elasticity. Using chain connectors may result in adverse effects on ride quality, may require special tooling, and may be difficult to install. Using wedge shaped liner that frictionally interlocked may be time consuming to install and remove.

BRIEF SUMMARY

Disclosed is a liner for a traction sheave comprising a top surface and a bottom surface mutually spaced on a height-wise axis (H), a front surface and a back surface mutually spaced on lengthwise axis (L), and a plurality of side surfaces including a first side surface and a second side surface mutually spaced in a widthwise axis (W), wherein in a first cross sectional profile of the plurality of side surfaces forms convergent-divergent profile.

In addition to one or more of the above disclosed features and elements or as an alternate the first profile is symmetric about the height-wise axis.

In addition to one or more of the above disclosed features and elements or as an alternate the first profile is constant along a lengthwise span of the liner.

In addition to one or more of the above disclosed features and elements or as an alternate in the top surface of the liner comprises a concave profile.

In addition to one or more of the above disclosed features and elements or as an alternate the concave profile is a semicircular profile.

In addition to one or more of the above disclosed features and elements or as an alternate in the bottom surface of the liner includes a first groove extending height-wise upwardly.

In addition to one or more of the above disclosed features and elements or as an alternate in the bottom surface of the liner includes a plurality of upwardly extending grooves including the first groove and a second groove.

In addition to one or more of the above disclosed features and elements or as an alternate the first profile includes a first neck portion whereat the liner is widthwise narrowest, the first neck portion being height-wise below the bottom of the semicircular profile.

In addition to one or more of the above disclosed features and elements or as an alternate a height-wise top of the liner has a first widthwise span, a height-wise bottom has a second widthwise span, and the first widthwise span is greater than the second widthwise span.

In addition to one or more of the above disclosed features and elements or as an alternate a bottom portion of the liner is height-wise below the first neck portion, and the liner is widthwise resiliently flexible in the bottom portion.

Further disclosed is a system comprising a traction sheave and the liner that includes one or more of the above disclosed features and elements, and wherein the traction sheave comprises a cavity having a same height-wise span as the liner, the cavity comprises a plurality of side surfaces having a second profile that is complementary to the first profile wherein the liner comprises a nominal clearance fit when seated within the cavity.

In addition to one or more of the above disclosed features and elements or as an alternate the cavity includes a second neck and wherein the bottom of the liner comprises a press fit against the second neck.

In addition to one or more of the above disclosed features and elements or as an alternate when seating the liner in the cavity, the liner is urged in a height-wise downward direction from a top opening of the cavity until the first bottom surface of the liner is proximate a second bottom surface of the cavity.

In addition to one or more of the above disclosed features and elements or as an alternate the bottom of the liner widthwise compresses when being press fit through the second neck.

In addition to one or more of the above disclosed features and elements or as an alternate the bottom of the liner comprises one or more grooves whereby the bottom of the liner widthwise compresses when being press fit through the second neck.

Further disclosed is a method of installing a liner in a cavity in a traction sheave, the liner comprising a top surface and a bottom surface mutually spaced on a height-wise axis (H), a front surface and a back surface mutually spaced on lengthwise axis (L), and a plurality of side surfaces including a first side surface and a second side surface mutually spaced in a widthwise axis (W), wherein in a first cross sectional profile of the plurality of side surfaces forms convergent-divergent profile, and the cavity includes a same height-wise span as the liner, the cavity comprising a plurality of side surfaces having a second profile that is complementary to the first profile wherein the liner comprises a nominal clearance fit when seated within the cavity, the method comprises urging the liner in a height-wise downward direction from the top of the cavity until the bottom surface of the liner is proximate a second bottom surface of the cavity.

In addition to one or more of the above disclosed features and elements or as an alternate the first profile includes a first neck portion whereat the liner is widthwise narrowest, and a bottom of the liner is height-wise below the first neck, and wherein the cavity includes a second neck and wherein the bottom of the liner comprises a press fit against the second neck.

In addition to one or more of the above disclosed features and elements or as an alternate the bottom of the liner comprises one or more grooves whereby the bottom of the liner widthwise compresses when being press fit through the second neck.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
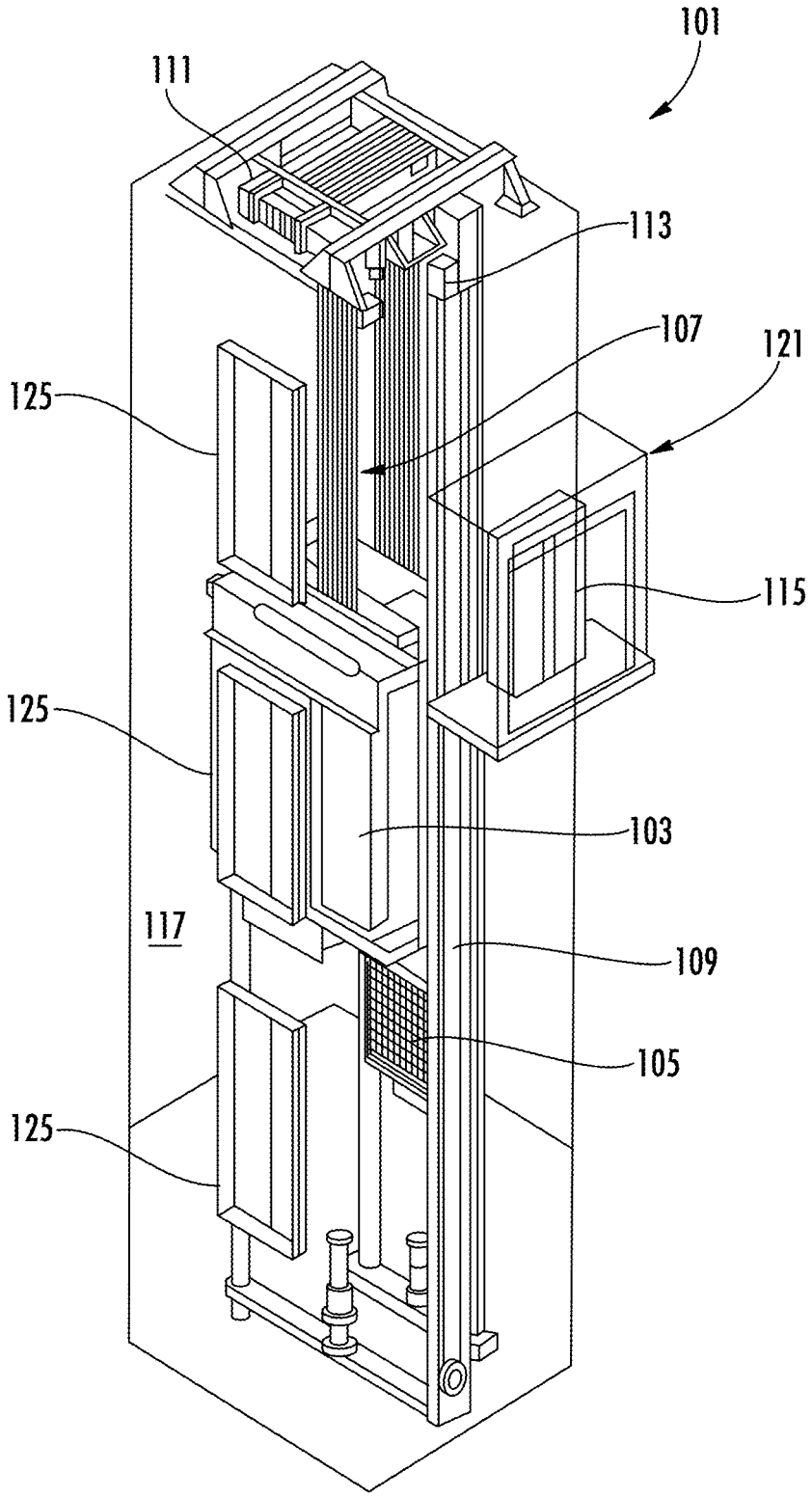
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
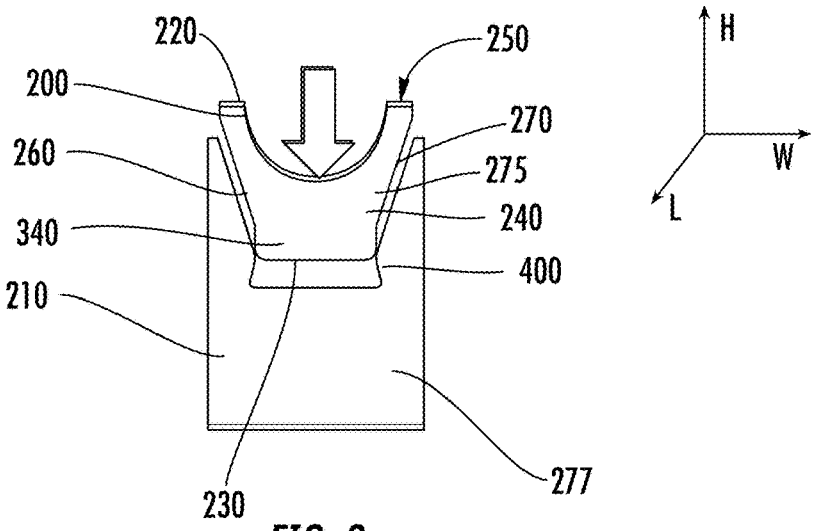
FIG. 2 illustrates a first embodiment of the disclosure in a first position.

Turning to FIG. 2, disclosed is a liner 200 for a traction sheave 210. The liner 200 may comprise a plurality of surfaces including a top surface 220 and a first bottom surface 230 mutually spaced on a height-wise axis H. The plurality of liner surfaces may include a front surface 240 and a back surface 250 mutually spaced on a lengthwise axis L. The plurality of liner surfaces may include a plurality of side surfaces including a first side surface 260 and a second side surface 270 mutually spaced on a widthwise axis W.

FIG. 2 illustrates a first cross section 275 for the liner 200 and a second cross section 277 for the sheave 210, where the first cross section and the second cross section are perpendicular to the lengthwise axis L. The remainder of the disclosure herein for the geometric properties of the liner 200 and the sheave 210 shall apply to the cross section thereof. The figures and specification describe a specific geometric property of the sheave and liner interface for simplicity, however it will be understood by those of ordinary skill in the art that the sheave liner embodiments described herein would apply to sheaves of various other geometries and configurations.

The plurality of side surfaces in the liner 210 form a first profile which may form a convergent-divergent profile. The plurality of liner surfaces may have a constant profile. The liner 200 may be symmetric about the height-wise axis H. The top surface 220 may form a concave profile. The concave profile may be a semicircular profile.

Figure 3:
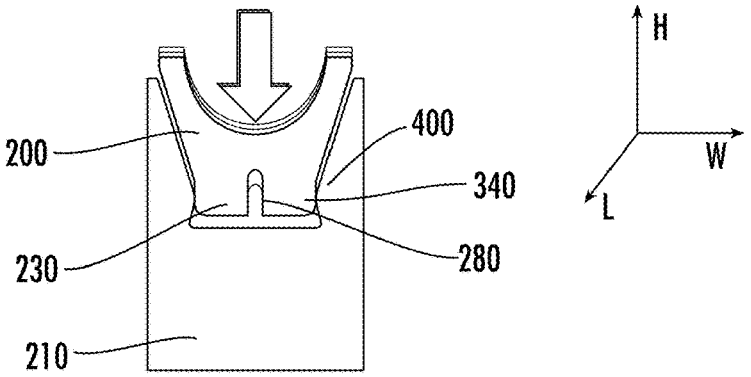
FIG. 3 illustrates a second embodiment of the disclosure in a second position.
Figure 4:
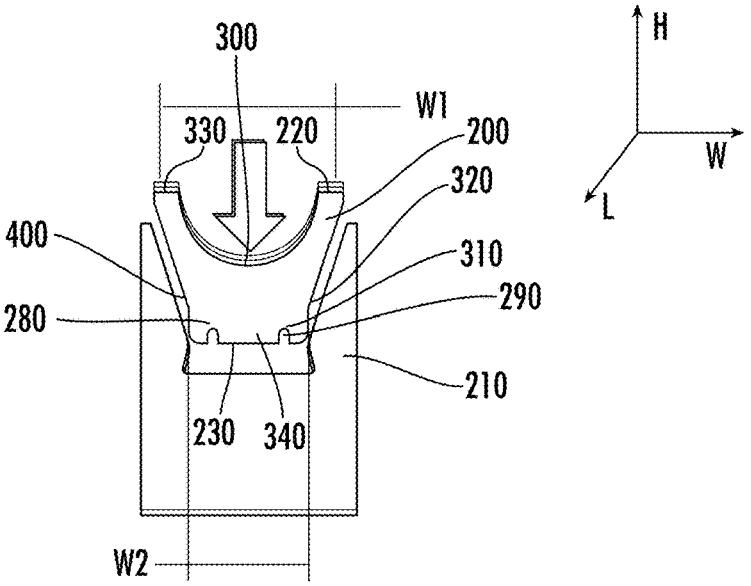
FIG. 4 illustrates a third embodiment of the disclosure in the first position.

Turning to FIG. 3, the first bottom surface 230 may comprise a first groove 280 extending upwardly on the height-wise axis H. Turning to FIG. 4, the first bottom surface 230 may comprise a plurality of upwardly extending grooves including the first groove 280 and a second groove 290. The semicircular profile of the top surface 220 may have a height-wise bottom 300 and the first groove may have a height-wise top 310. The convergent-divergent profile may include a first neck portion 320 whereat the liner 200 may be widthwise narrowest. The first neck portion 320 may be intermediate the height-wise bottom 300 of the semicircular profile and the height-wise top 310 of the first groove 280. A height-wise top 330 of the liner 200 may have a first widthwise span W1. The height-wise bottom, that is, the first bottom surface 230, may have a second widthwise span W2. The first widthwise span W1 may be greater than the second widthwise span W2.

A bottom portion 340 of the liner 200 may be height-wise between the first neck portion 320 and the first bottom surface 230. The liner 200 may be widthwise resiliently flexible in the bottom portion 340. With this configuration the liner 200 may be fixedly mated to the traction sheave 210, discussed below.

In one embodiment the liner 200 has a length that approximates or is the same as the circumferential span of the traction sheave 210. In such embodiment the liner 200 may be seated, that is, installed in the sheave 210 as a single piece. In one embodiment the liner 200 has a length that is greater than the circumferential span of the traction sheave 210. In such embodiment the liner 200 may be installed in the traction sheave 210 as a single piece and trimmed during installation to a length that approximates or is the same as the circumferential span of the traction sheave 210. In one embodiment the liner 200 has a length that is less than the circumferential span of the traction sheave 210. In such embodiment, a plurality of the liners 200 may be installed in the traction sheave 210 as may be required to accommodate the circumferential span of the traction sheave 210.

Figure 5:
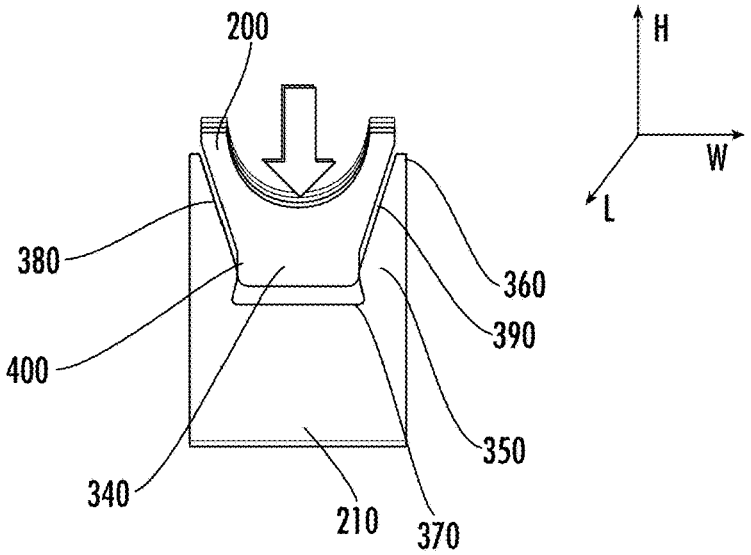
FIG. 5 illustrates the first embodiment of the disclosure in the second position.

Turning now to FIG. 5, further disclosed is a cavity 350 in the traction sheave 210. The cavity 350 may comprise a top opening 360 and a second bottom surface 370 mutually spaced on the height-wise axis H. The cavity 350 may have a plurality of side surfaces, including a third side surface 380 and a fourth side surface 390 that are spaced on the width-wise axis W.

Figure 6:
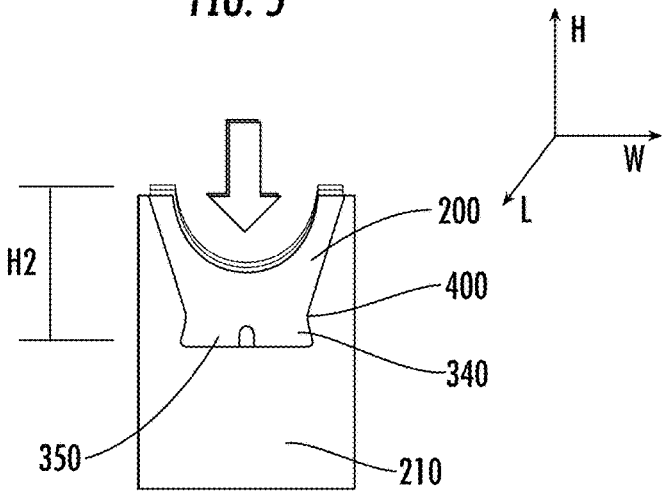
FIG. 6 illustrates the second embodiment of the disclosure in the third position.
Figure 7:
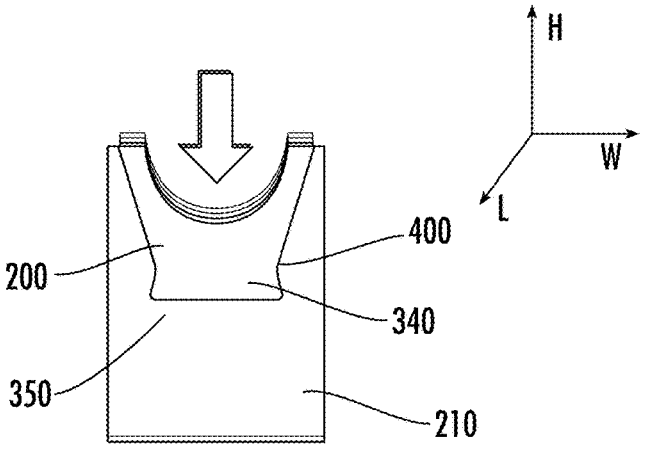
FIG. 7 illustrates the first embodiment of the disclosure in the third position.

As illustrated in FIG. 6, the liner 200 and cavity 350 may have a same height-wise span H2. The plurality of side surfaces of the cavity 350 may have a second profile that is complementary to the first profile. That is, the second profile may be a geometric inverse of the first profile so that the liner 200 may have a nominal clearance fit when seated within the cavity 350. As illustrated in FIG. 7, with the above configuration the cavity 350 may have second neck portion 400 that forms a clearance fit with the first neck portion 340 and an interference fit with the bottom portion 340 of the liner 200.

A method of installing the liner 200 in the traction sheave 210 includes urging the liner 200 in a height-wise downward direction from the top 360 of the cavity 350 until the 230 bottom surface of the liner 200 is proximate the second bottom surface 370 of the cavity 350. This process is illustrated in FIGS. 2, 5 and 7 for a configuration of the liner 200 without a bottom groove, in FIGS. 3 and 5 for a configuration of the liner 200 with one bottom groove 280, and FIG. 4 for a configuration of the liner 200 with a plurality of bottom grooves.

Due to the interference fit at the neck portion 400 of the cavity 350, the bottom portion 340 of the liner 200 contracts in the widthwise direction as it passes through the neck portion 400 of the cavity 350. Thereafter the bottom portion 340 of the liner 200 expands in the widthwise direction when fully seated in the cavity 35, that is, when the first bottom surface 230 is adjacent the second bottom surface 370. This configuration fixedly positions the liner 200 in the cavity 350. The groove 280 or grooves 280, 290 in the bottom portion 340 of the liner 200 enable a reduction of the downward force required to seat the liner 200 in the cavity 350. The liner 200 may be widthwise resiliently flexible in the bottom portion 340 to enable downwardly passing through the neck portion 400 of the cavity 250 in the traction sheave 210.

With the above disclosed embodiments, the cavity 350 contains an integrated retention feature, which may be an undercut groove, referred to above as the neck portion 400, which may eliminate a need for ancillary fastening hardware. The liner 200 may have protrusions, referred to above as grooves 280, 290, at the base 340 which may be contained within the undercut cavity. The liner 200 may be forced into the cavity 350 and firmly retained by interlocking of the liner 200 in the cavity 350. The insertion force may be adjusted by 1) changing an amount of interference between the liner 200 and cavity during the insertion process and/or 2) by adding a groove 280 (or multiple grooves 280, 290) to the base 340 of the liner 200.

The disclosed embodiments may also provide a low liner and method of liner retention that may not require special tooling, may be easy to install and remove, and may not affect existing sheave dimensions, such as pitch and diameter. The disclosed liner and method of attachment may also enables a continuous manufacturing process, for example by extrusion, depending on a selected liner material.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A liner for a traction sheave comprising a top surface and a bottom surface mutually spaced on a height-wise axis (H), a front surface and a back surface mutually spaced on lengthwise axis (L), and a plurality of side surfaces including a first side surface and a second side surface mutually spaced in a widthwise axis (W), wherein in a first cross sectional profile of the liner, defined by the plurality of side surfaces forms convergent-divergent profile, such that:

the first cross sectional profile includes a first neck portion intermediate of the top and bottom surfaces, whereat the liner is widthwise narrowest;

a top portion of the liner is height-wise above the first neck portion and a bottom portion of the liner is height-wise below the first neck portion;

in the top portion of the liner, the plurality of side surfaces converge between the top surface and the first neck portion;

in the bottom portion of the liner, the plurality of side surfaces diverge between the first neck portion and the bottom surface; and first and second grooves are formed to extend height-wise upwardly from the bottom surface and toward the top surface, intermediate of widthwise ends of the bottom surface, wherein the first and second grooves are widthwise spaced apart from each other.

2. The liner of claim 1 wherein the first profile is symmetric about the height-wise axis.

3. The liner of claim 1 wherein the first profile is constant along a lengthwise span of the liner.

4. The liner of claim 1 wherein in the top surface of the liner comprises a concave profile.

5. The liner of claim 4 wherein the concave profile is a semicircular profile.

6. The liner of claim 1 wherein the first neck portion is height-wise below the bottom of the semicircular profile.

7. The liner of claim 1 wherein a height-wise top of the liner has a first widthwise span, a height-wise bottom has a second widthwise span, and the first widthwise span is greater than the second widthwise span.

8. The liner of claim 1 wherein the liner is widthwise resiliently flexible in the bottom portion.

9. A system comprising a traction sheave and the liner of claim 1 wherein the traction sheave comprises a cavity having a same height-wise span as the liner, the cavity comprising a plurality of side surfaces having a second profile that is complementary to the first profile wherein the liner comprises a nominal clearance fit when seated within the cavity.

10. The system of claim 9 wherein the cavity includes a second neck and wherein the bottom of the liner comprises a press fit against the second neck.

11. The system of claim 10 wherein the bottom of the liner widthwise compresses when being press fit through the second neck.

12. The system of claim 9 wherein when seating the liner in the cavity:

(i) the lengthwise span of the liner approximates a circumferential span of the traction sheave and the liner is seated in the traction sheave as a single piece; or (ii) the lengthwise span of the liner is greater than the circumferential span of the traction sheave and the liner is seated in the traction sheave as a single piece and trimmed during seating to a length that approximates the circumferential span of the traction sheave; or (iii) the lengthwise span of the liner is less than the circumferential span of the traction sheave and a plurality of liners are seated in the traction sheave.

13. The system of claim 9 wherein when seating the liner in the cavity, the liner is urged in a height-wise downward direction from a top opening of the cavity until the first bottom surface of the liner is proximate a second bottom surface of the cavity.

14. The liner of claim 1, wherein the bottom surface extends only along the widthwise direction from the first groove and toward the widthwise ends of the bottom surface.

* * * * *